US006949500B2

(12) United States Patent
Salesses et al.

(10) Patent No.: US 6,949,500 B2
(45) Date of Patent: Sep. 27, 2005

(54) FABRIC SOFTENER COMPOSITIONS CONTAINING A MIXTURE OF CATIONIC POLYMERS AS RHEOLOGY MODIFIERS

(75) Inventors: Isabelle Salesses, Liege (BE); Ericka Breuer, Grace Hollogne (BE); Georges Yianakopoulos, Liege (BE); Patricia Pagnoul, Amay (BE)

(73) Assignee: Colgate-Palmolive Company, New York, NY (US)

( * ) Notice: Subject to any disclaimer, the term of this patent is extended or adjusted under 35 U.S.C. 154(b) by 165 days.

(21) Appl. No.: 10/320,067

(22) Filed: Dec. 16, 2002

(65) Prior Publication Data

US 2004/0116321 A1 Jun. 17, 2004

(51) Int. Cl.[7] ..... C11D 3/37
(52) U.S. Cl. ..... 510/475; 510/522; 510/527
(58) Field of Search ..... 510/522, 527, 510/475

(56) References Cited

U.S. PATENT DOCUMENTS

| | | | | | |
|---|---|---|---|---|---|
| 4,719,104 | A | * | 1/1988 | Patel | 424/70.17 |
| 4,806,345 | A | | 2/1989 | Bhattacharyya | 424/70 |
| 4,885,102 | A | * | 12/1989 | Yamamura et al. | 510/522 |
| 5,114,600 | A | * | 5/1992 | Biggin et al. | 510/522 |
| 5,989,536 | A | * | 11/1999 | Deckner et al. | 424/78.05 |
| 6,329,057 | B1 | * | 12/2001 | Dungworth et al. | 428/403 |
| 6,620,777 | B2 | * | 9/2003 | Heibel et al. | 510/516 |

FOREIGN PATENT DOCUMENTS

| | | | |
|---|---|---|---|
| DE | 4313085 | * | 10/1994 |
| EP | 494554 | * | 7/1992 |
| EP | 0394133 | | 8/1997 |
| EP | 0799887 | | 10/1997 |
| WO | 90/12862 | | 11/1990 |
| WO | WO 94/24255 | * | 10/1994 |
| WO | 02/057400 | | 7/2002 |

* cited by examiner

*Primary Examiner*—John R. Hardee
(74) *Attorney, Agent, or Firm*—Bernard Lieberman

(57) ABSTRACT

An aqueous fabric softening composition is described having its rheological properties of flow elasticity and viscosity capable of being readily modified as needed independently of each other to satisfy a consumer preference, said composition comprising:

a) from about 0.01% to about 25%, by weight, of a cationic fabric softener;

b) an effective amount of a mixture of cationic polymers capable of modifying the aforesaid rheological properties, said mixture comprising:

(iii) from about 0.01% to about 90%, by weight, of a cationic linear homopolymer that is derivable from the polymerization of acrylic acid and/or methacrylic acid or a linear copolymer that is derivable from the polymerization of acrylic acid and/or methacrylic acid and acrylamide or methacrylamide, said homopolymer or copolyer having a molecular weight of from about 10,000 to about 30 million; and (iv) from about 10% to about 99.99%, by weight, of a cationic cross-linked polymer that is derivable from the polymerization of, from 5 to 100 mole percent of cationic vinyl addition monomer, from 0 to 95 mole percent of acrylamide, and from 70 ppm to 300 ppm of a difunctional vinyl addition monomer cross linking agent, the respective amounts of (i) and (ii) in said mixture being selected to provide the desired rheological properties of viscosity and flow elasticity in said softening composition; and c) balance water.

9 Claims, No Drawings

FABRIC SOFTENER COMPOSITIONS CONTAINING A MIXTURE OF CATIONIC POLYMERS AS RHEOLOGY MODIFIERS

TECHNICAL FIELD OF THE INVENTION

The present invention relates to fabric conditioning compositions, and especially to aqueous rinse-cycle fabric softener compositions comprising at least one cationic fabric softener and a mixture of cationic polymers capable of modifying the rheological properties of such softener compositions.

BACKGROUND OF THE INVENTION

Conventionally, most liquid fabric conditioning or fabric softener compositions make use of the thickening properties of surfactant ingredients or added salts to provide a desired rheology. More recently, the trend has been to incorporate specific thickeners into fabric softening compositions to provide a desired viscosity which remains stable over extended periods of time.

In commercial liquid fabric softener formulations the rheological properties of the product are critical for consumer acceptance. A common method of enhancing product appeal and conveying a perception of product richness and efficacy is to increase the apparent viscosity of the liquid product to a value of at least above 50 cps (as measured on a Brookfield RVT, 50 rpm, Spindle 2). Another common technique for enhancing product appeal is to modify the flow elasticity components of the liquid product so as to reduce the flow thereby rendering it more syrupy in nature while avoiding an aesthetically unpleasing stringy and non-uniform flow.

Cationic linear or cross-linked polymers are well-known in the art as ingredients to provide apparent viscosity in fabric softener compositions. However, there is no known method to modify the flow elasticity properties at a given level of viscosity insofar as flow elasticity is a function of the cationic polymer structure itself, and its level in the product composition.

Linear cationic polymers having high molecular weights are known to provide high flow elasticity to liquid fabric softeners. But, the resulting compositions are often sensitive to inorganic electrolytes and high shear resulting in liquid products which are generally unstable and separate into different phases upon aging.

In EP 394 133 (Colgate-Palmolive) there are described stable aqueous fabric softening compositions containing a di-long chain, di-short chain quaternary ammonium softening compound in combination with a fatty alcohol and a water-soluble polymer to improve the rheological properties and enhance the softening performance of the composition.

WO 90/12862 (BP Chemicals Ltd.) discloses aqueous based fabric conditioning formulations comprising a water dispersible cationic softener and as a thickener a cross-linked cationic polymer that is derivable from a water soluble cationic ethylenically unsaturated monomer or blend of monomers, which is cross-linked by 5 to 45 ppm of a cross-linking agent comprising polyethylenic functions. An example of such a cross-linking agent is methylene bis acrylamide.

In EP-A-0 799 887 (Procter & Gamble) liquid fabric softening compositions are described which are said to exhibit an excellent viscosity and phase stability as well as softness performance, which compositions comprise: (a) 0.01–10 wt. % of a fabric softener component, (b) at least 0.001% of a thickening agent selected from the group of (i) associative polymers having a hydrophilic backbone and at least two hydrophobic groups per molecule attached to the hydrophilic backbone, (ii) the cross-linked cationic polymers described in the above-mentioned WO 90/12862, cross-linked by 5–45 ppm of cross-linking agent comprising polyethylenic functions and (iii) mixtures of (i) and (ii), and (c) a component capable of sequestering metal ions.

In WO 02/057400 (Colgate-Palmolive) fabric conditioning compositions are described containing cationic polymeric thickeners obtained by polymerizing a water soluble cationic vinyl addition monomer, from 0 to 95 mole percent of acrylamide and from 70 to 300 ppm of difunctional vinyl addition monomer cross-linking agent. The thickened softening compositions are stated to be especially efficient for delivering fragrance in the softening composition to the treated fabrics.

While the use of polymeric thickeners to enhance consumer appeal is widely known in the prior art, there remains a need for liquid fabric softeners wherein the rheological properties of viscosity and flow elasticity can be modified independently of each other so as to provide an efficient method of optimizing the flow profile of the fabric softener product in response to a particular consumer preference.

SUMMARY OF THE INVENTION

The present invention provides an aqueous fabric softening composition having its rheological properties of flow elasticity and viscosity capable of being readily modified as needed independently of each other to satisfy a consumer preference, said composition comprising:

a) from about 0.01% to about 25%, by weight, of a cationic fabric softener;

b) at least about 0.001%, by weight, of a mixture of cationic polymers capable of modifying the aforesaid rheological properties, said mixture comprising:

(i) from about 0.01% to about 90%, by weight, of a cationic linear homopolymer that is derivable from the polymerization of acrylic acid and/or methacrylic acid or a linear copolymer that is derivable from the polymerization of acrylic acid and/or methacrylic acid and acrylamide or methacrylamide, said homopolymer or copolymer having a molecular weight of from about 10,000 to about 30 million; and (ii) from about 10% to about 99.99%, by weight, of a cationic cross-linked polymer that is derivable from the polymerization of, from 5 to 100 mole percent of cationic vinyl addition monomer, from 0 to 95 mole percent of acrylamide, and between 70 and 300 ppm of a difunctional vinyl addition monomer cross linking agent, the respective amounts of (i) and (ii) in said mixture being selected to provide the desired rheological properties of viscosity and flow elasticity in said softening composition;

c) from 0% to about 10% by weight of a sequestering compound selected from the group consisting of amino-carboxylic acid compounds, organo aminophosphonic acid compounds and mixtures thereof;

d) from 0% to about 5% by weight of a perfume;

e) from 0% to about 10% by weight of an emulsifier;

f) from 0 to about 10% by weight of one or more adjuvants selected from the group consisting of dyes, opacifying agent, bluing agents and preservatives; and g) balance water.

The present invention is predicated on the discovery that the use of a mixture of cationic polymers as defined herein in an aqueous rinse-cycle fabric softening composition allows the rheological properties of flow elasticity and viscosity to be independently regulated over a wide range of values so as to achieve the desired flow properties of flow elasticity, thickness and ease of pourability according to a particular consumer preference. Accordingly, flow elasticity can be readily controlled and regulated according to the present invention independently of the regulation of the Brookfield viscosity.

The liquid viscosity as that term is used herein is expressed in centipoise as measured on a Brookfield RVT at 50 rpm with Spindle 2.

The term "flow elasticity" or "flow elasticity index" refers to the primary normal stress difference in units of Pascal as defined in "Viscoelastic Properties of Polymers", John D. Ferry, 3rd Edition, John Wiley & Sons, Inc., Chapter 1, which is measured at a shear rate of $2500S^{-1}$.

In practice, when a liquid fabric softener is poured, a high flow elasticity reduces the flow thereby making the flow appear more syrupy, which is often perceived as a signal of richness by consumers. The higher the flow elasticity, the slower the flow. If the flow elasticity becomes too high, the flow of the fabric softener becomes stringy and tacky leading to messiness when dispensing the liquid product into the washing machine. This is obviously an unwanted condition from a commercial standpoint.

For a given chemistry, the only way to modify the elasticity flow as defined herein is to either modify the molecular weight of the polymer, its degree of cross-linking or its concentration.

In the case of a linear polymer, in order to build acceptable Brookfield viscosity without using a large amount of polymer, the molecular weight of the polymer must be high which induces high flow elasticity. It is possible to reduce the flow elasticity using a low molecular weight polymer but to reach the same Brookfield viscosity, the level of polymer in the composition has to be significantly increased. This not only implies a higher cost but also introduces a stability problem in the emulsion due to the high ionic strength.

In contrast thereto, the combination of linear and cross-linked polymer in accordance with the invention is able to provide a desirable viscosity and flow elasticity while using a moderate amount of polymer and at the same time avoiding problems of product stability.

In a preferred embodiment the linear polymer used in the polymeric mixture of the invention is an homopolymer of quaternary ammonium acrylate having a molecular weight of about 8 million which polymer is sold as Floerger EM 949 CT by SNF Floerger of France (Ethanaminium N,N,N-trimethyl-2-((1-oxo-2-propenyl)oxy-,chloride homopolymer); and the same structural polymer having a molecular weight of about 5 million is sold as Floerger EM 949 L by the same manufacturer.

In another preferred embodiment the cross-linked polymer used in the polymeric mixture of the invention is a cross-linked copolymer of acrylamide and methacrylate with 150 ppm of methylene bisacrylamide, and a molecular weight of below 5 million prior to the cross-linking; the polymer is sold as Flosoft DP 200 by SNF Floerger of France.

The present invention also encompasses a method for softening fabrics comprising rinsing the fabrics to be treated in an aqueous bath containing an effective amount of the above-defined fabric softening composition.

A preferred cationic softener is an esterquat compound having the following structural formula:

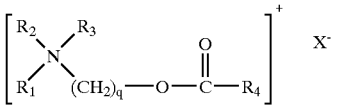

wherein R4 represents an aliphatic hydrocarbon group having from 8 to 22 carbon atoms, $R_2$ and $R_3$ represent $(CH_2)_s$—$R_5$ where $R_5$ represents an alkoxy carbonyl group containing from 8 to 22 carbon atoms, benzyl, phenyl, (C1–C4)-alkyl substituted phenyl, OH or H; R1 represents $(CH_2)_t$ $R_6$ where $R_6$ represents benzyl, phenyl, (C1–C4)-alkyl substituted phenyl, OH or H; q, s, and t, each independently, represent an integer from 1 to 3; and $X^-$ is a softener compatible anion.

A particularly preferred cationic softener is a fatty ester quaternary ammonium compound derived from the reaction of an alkanol amine and a fatty acid derivative followed by quaternization, said fatty ester quaternary ammonium compound being represented by the formula:

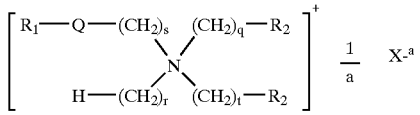

wherein Q represents a carboxyl group having the structure —OCO— or —COO—; R1 represents an aliphatic hydrocarbon group having from 8 to 22 carbon atoms; R2 represents -Q-R1 or —OH; q, r, s and t, each independently represent a number of from 1 to 3; and $X^{-a}$ is an anion of valence a; and wherein said fatty ester quaternary ammonium compound is comprised of a distribution of monoester, diester and triester compounds, the monoesterquat compound being formed when each $R_2$ is —OH; the diesterquat compound being formed when one $R_2$ is —OH and the other $R_2$ is -Q-R1; and the triesterquat compound being formed when each $R_2$ is -Q-R1; and wherein the normalized percentage of monoesterquat compound in said fatty ester quaternary ammonium compound is from about 28% to about 39%; the normalized percentage of diesterquat compound is from about 52% to about 62% and the normalized percentage of triesterquat compound is from about 7% to about 14%; all percentages being by weight.

The percentages, by weight, of mono, di, and tri esterquats, as described above are determined by the quantitative analytical method described in the publication "*Characterisation of quaternized triethanolamine esters*

(*esterquats*) *by HPLC, HRCGC and NMR*" A. J. Wilkes, C. Jacobs, G. Walraven and J. M. Talbot—Colgate Palmolive R&D Inc.—4th world Surfactants Congress, Barcelone, 3–7 VI 1996, page 382. The percentages, by weight, of the mono, di and tri esterquats measured on dried samples are normalized on the basis of 100%. The normalization is required due to the presence of about 10% to 15%, by weight, of non-quaternized species, such as ester amines and free fatty acids. Accordingly, the normalized weight percentages refer to the pure esterquat component of the raw material.

DETAILED DESCRIPTION OF THE INVENTION

The cross-linked copolymer used in the compositions of the present invention is a cross-linked cationic vinyl polymer which is cross-linked using a cross-linking agent of a difunctional vinyl addition monomer at a level of from 70 to 300 ppm, preferably from about 75 to 200 ppm, and most preferably of from about 80 to 150 ppm. These polymers are further described in U.S. Pat. No. 4,806,345 and the above-mentioned WO 02/057400, which documents are incorporated herein by reference.

Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell.

The most preferred thickener for use in the present invention is a cross-linked copolymer of a quaternary ammonium acrylate or methacrylate in combination with an acrylamide comonomer.

The linear polymer used in the compositions of the present invention is a water soluble linear cationic homopolymer of acrylate or methacrylate with a molecular weight of between 10,000 and 30 million, most preferably between 5 and 8 million.

Such polymers are usually prepared as a water in oil emulsions which may contain surfactants but are also supplied in powdered form.

Preferred polymer for use in the present invention is a linear homopolymer of quaternary ammonium acrylate with a molecular weight of 8 Million.

The present softener compositions are provided as aqueous dispersions in which the cationic softener compounds are present in finely divided form stably dispersed in the aqueous phase. Generally, particle sizes of the dispersed particles of less than about 25 microns ($\mu$m), preferably less than 20 $\mu$m, especially preferably no more than 10 $\mu$m, on average are acceptable for both softening and stability insofar as the particle sizes can be maintained during actual use, typically in the rinse cycle of an automatic laundry washing machine. The lower limit is not particularly critical but from a practical manufacturing standpoint will not generally be below about 0.01 $\mu$m, preferably at least about 0.05 $\mu$m. A preferred particle size range of the dispersed softener ingredients is from about 0.1 to about 8 $\mu$m.

The softener compositions of the invention may include an electrolyte to reduce the dispersion viscosity and to maintain a stable low viscosity on the order of less than about 500 cps and more preferably 250 cps for long periods of time for ready to use products. Generally, any of the alkaline metals or alkaline earth metal salts of the mineral acids can be used as electrolyte. Based on their availability, solubility and low toxicity, NaCl, $CaCl_2$, $MgCl_2$ and $MgSO_4$ and similar salts of alkaline and alkaline earth metals are preferred, and $CaCl_2$ is especially preferred. The amount of the electrolyte will be selected to assure that the composition reaches viscosity below 500 cps and more preferably 250 cps. Generally, amounts of electrolyte salt needed are from 0.01% to 1.0 wt %, and preferably from 0.01 to 0.40 wt %.

If necessary, the compositions of the invention may contain an emulsifier to disperse the softening ingredient(s) in the composition and to insure the physical stability of the composition. Optionally, an emulsifier may be included in the softener composition, such as, a fatty alcohol ethoxylate having an alkyl chain length from about 13 to 15 carbon atoms and wherein the number of ethylene groups is from about 15 to 20 per mole. Especially preferred for such use is Synperonic A20 manufactured by ICI Chemicals, a non-ionic surfactant which is an ethoxylated $C_{13}$–$C_{15}$ fatty alcohol with 20 moles of ethylene oxide per mole of alcohol.

The compositions of the invention may contain from 0% to about 5% of a perfume. As used herein, the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes), the essential oils themselves being volatile odoriferous compounds and also serving to dissolve the other components of the perfume.

In the present invention, the particular composition of the perfume is of no importance with regard to the performance of the liquid fabric softener composition so long as it meets the criteria of water immiscibility and having a pleasing odor.

The compositions of the invention may contain from 0% to about 2% of a preservative agent such as solutions of lactic acid or formaldehyde or dispersion of 1,2-dibromo-2,4-dicyanobutane mixed with bromonitro propanediol (Euxyl K446 from Schulke & Mayr) or dispersion of 1.2-benzisothiazolin-3-one molecule (Proxel BD2 or GXL from Avecia Biocides).

To prevent gelation of super-concentrated liquid compositions, the compositions may contain a polyethylene glycol polymer or polyethylene glycol alkyl ether polymer. The polyethylene glycol polymers useful herein have a molecular weight of at least 200 up to a molecular weight of about 8,000. Useful polymers include the polyethylene glycol and polyethylene glycol methyl ether polymers marketed by Aldrich Chemical Company. Useful amounts of polymer in the composition range from about 0.1% to about 5%, by weight. A range of from about 0.5 to about 1.5%, by weight, is preferred.

A co-softener may optionally be included in the present composition such as, for example, fatty alcohol, glycerol mono-stearate or glycerol mono-oleate.

Other optional components commonly used in fabric softening compositions may be added in minor amounts to enhance either the appearance or performance properties of the liquid fabric softener compositions of this invention. Typical components of this type include, but are not limited to colorants, e.g., dyes or pigments, bluing agents and germicides, opacifying agents.

The fabric softener composition, whether in concentrated or diluted form must be easily pourable by the end user. Generally, therefore, product viscosity when used by the consumers should not exceed about 10000 centipoises for products intended for dilution, and 500 centipoises for ready to use products, preferably not more than 250 cps. As used herein, unless otherwise specified, viscosity is measured at 25° C. (22–26° C.) using a Brookfield RVTD Digital Viscometer with Spindle #2 at 50 rpm.

A sequestering or chelating compound may optionally be included in the fabric softening compositions of the invention at a concentration of from 0% to 2%, by weight. The useful sequestering compounds are capable of sequestering metal ions and are present at a level of at least 0.001%, by weight, of the softening composition, preferably from about 0.001% (10 ppm) to 0.5%, and more preferably from about 0.005% to 0.25%, by weight. The sequestering compounds which are acidic in nature may be present either in the acidic form or as a complex/salt with a suitable counter cation such as an alkali or alkaline earth metal ion, ammonium or substituted ammonium ion or any mixtures thereof.

The sequestering compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA).

Suitable organo aminophosphonic acid compounds include: ethylenediamine tetrakis (methylenephosphonic acid); 1-hydroxyethane 1,1-diphosphonic acid (HEDP); and aminotri (methylenephosphonic acid).

EXAMPLE 1

A typical regular (i.e. non-concentrated) fabric softening composition of the invention was prepared as shown below containing as the cationic softener, Esterquat B, which is characterized by a distribution of about 34% monoester, about 56% diester, and about 10% triester compounds (normalized percent by weight on dried samples).

| Ingredient | Commercial name | % actives |
|---|---|---|
| Esterquat B | L190s (ex Kao) | 3.6% |
| Cationic cross-linked polymer | Flosoft DP 200 (ex SNF) | 0.12% |
| Linear polymer | Floerger 949CT(ex SNF) | 0.02% |
| Perfume | | QS |
| Dyes | | QS |
| Preservatives | | QS |
| Sequestring agent | | QS |

Compositions (numbers 1–5) were prepared which varied in the respective amounts of linear and cross-linked polymer. The flow elasticity index was measured by the primary normal values of stress differences at a shear rate of 2500s-1 in a steady shear rheological experiment. The higher values of normal stress (expressed in Pascal) correspond to a high flow elasticity.

Experimental Conditions:

Normal forces were measured using a Physica USD 200 rheomether at a shear rate of 2500s-1.

Compositions 1–5 which were tested are reported in Table 1 below (on a 100% actives basis):

TABLE 1

| Composition Number | Esterquat B (L1-90) | Linear homopolymer Floerger 949 CT | Cross-linked copolymer Flosoft DP200 | Ratio Flosoft DP200/Floerger 949 CT | Brookfield viscosity at RT, 50 rpm, spindle 2 | Flow elasticity index in Pascal at 2500 s − 1 |
|---|---|---|---|---|---|---|
| 1 | 3.6% | — | 0.14% | 100/0 | 161 cps | 80 Pa |
| 2 | 3.6% | 0.02% | 0.12% | 85.7/14.3 | 150 cps | 350 Pa |
| 3 | 3.6% | 0.0647% | 0.0637% | 49.6/50.4 | 143 cps | 700 Pa |
| 4 | 3.6% | 0.0967% | 0.0147% | 13.2/86.8 | 155 cps | 800 Pa |
| 5 | 3.6% | 0.106% | — | 0/100 | 142 cps | 850 Pa |

Compositions 2, 3 and 4 of Table 1 were formulated as compositions in accordance with the invention. Compositions 1 and 5 are comparative compositions outside of the invention.

As evidenced in Table 1, Compositions 1 and 5 containing only a single linear homopolymer (#5) or only a cross-linked copolymer (#1) as a rheology modifier manifested very different flow behavior despite both compositions being nearly at the same viscosity of 150 cps (±10 cps). Thus, with a flow elasticity of below 200 Pascal (Pa), Composition 1 flowed rapidly out of the bottle, and manifested water-like flow properties. This type of rheology is generally perceived by consumers as being less efficacious than a product with the same Broodfield viscosity but having a higher flow elasticity in the preferred range of 200–700 Pa.

As can be noted in Compositions 1 and 5, each contained about 0.1% of a polymeric thickener and had a similar apparent viscosity, yet the flow elasticity varied greatly and is determined by the inherent nature and structure of the polymer itself. Compositions 4 and 5 which manifested a flow elasticity above 700 Pascal provided a type of liquid flow which is perceived to be very viscous but which nevertheless has several significant flow problems, such as (a) the flow is non-uniform; (b) after pouring the composition from the bottle a sticky "string" remains as a residue which is difficult to break; (c) significant amounts of product often remain in the bottle cap and along the sides of the bottle; (d) the overall experience of dispensing the product from the bottle into a washing machine dispenser is messy.

In Compositions 2, 3 and 4 of the invention, the use of different mixtures of linear and cross-linked copolymer provided a means of regulating the flow elasticity from 350 to 800 Pa while keeping the Brookfield viscosity constant.

EXAMPLE 2

A typical concentrated fabric softening composition of the invention intended for 4:1 dilution is shown below containing as the cationic softener Esterquat B, described in Example 1.

| Ingredient | Commercial name | % actives |
|---|---|---|
| Esterquat B | L190s (ex Kao) | 15% |
| Cationic cross-linked polymer | Flosoft DP 200(ex SNF) | 0.5% |
| Linear polymer | Floerger 949L (ex SNF) | 0.18% |
| Perfume | | QS |
| Dyes | | QS |
| Preservatives | | QS |
| Sequestring agent | | QS |

Compositions 6, 7 and 8 described in Table 2 below were prepared to demonstrate the synergy obtained by providing a mixture of polymers as rheology modifiers in accordance with the invention for the purpose of regulating flow elasticity and viscosity, as compared to the use of a linear homopolymer by itself and a cross-linked copolymer by itself. Compositions 6 and 8 are comparative compositions outside of the invention, each containing about the same level of a polymeric rheology modifier, while Composition 7 is a fabric softener in accordance with the invention containing a mixture of polymers, but at a total level below that of comparative Compositions 6 and 8.

The flow elasticity index of different compositions was measured as described in Example 1.

TABLE 2

| Composition Number | L190 | Linear Homopolymer Floerger 949CT | Cross-linked copolymer Flosoft DP200 | Ratio cross-linked copolymer/linear polymer | Brookfield viscosity at RT, 50 rpm, spindle 2 | Flow elasticity index in Pascal at 2500 s − 1 |
|---|---|---|---|---|---|---|
| 6 | 15% | — | 0.56% | 100/0 | 7200 cps | 300 Pa |
| 7 | 15% | 0.06% floerger | 0.34% | 85/15 | 7500 cps | 1300 Pa |
| 8 | 15% | 0.53% floerger | — | 0/100 | 7300 cps | 5300 Pa |

As evidenced from Table 2, all three compositions manifested nearly the same Brookfield viscosity, but comparative Compositions 6 and 8 had a Flow Elasticity Index of 300 and 5,300 Pa, respectively, which provided unacceptable flow behavior as either being too water-like in its flow behavior (Composition 6) or too non-uniform, too stringy and too messy for product dispensation from a bottle (Composition 8).

Composition 7, on the other hand, manifested a desirable viscosity for a concentrated formula of 7,500 cps, similar to comparative Compositions 6 and 8, but unlike the comparative compositions it manifested a commercially desirable Flow Elasticity Index of 1,300 Pa which avoided problems of stringiness and product dispensation from a bottle.

The flow elasticity index expressed by the normal stresses is only one element of the flow characteristics of a product. Further, this index is linked to the other characteristics of the flow, especially to the macroscopic viscosity. As a result, the ideal flow elasticity range will depend on the product viscosity and its intended use.

Two different categories of products can be differentiated: ready to use products on the one hand and products to be diluted before use on the other hand.

For ready to use products where the viscosity is between 50 cps and 500 cps, more preferably between 50 and 250 cps, the ideal flow elasticity range is between 200 and 700 Pa. The term "ready to use" refers to a formulation that can be added directly in the dispenser of the washing machine. This kind of compositions refers to regular or concentrated formulations. By regular is intended a concentration in softening agent comprised generally between 2% and 8%. Concentrated formulas contain usually between 10% and 25%.

For products intended to be diluted before use and for which the viscosity is above 500 cps higher flow elasticity index can be tolerated. Preferred range is between 300 and 1500 Pa. Products to be diluted are concentrated and commonly diluted to 4:1 or 8:1 ratio.

What is claimed is:

1. An aqueous fabric softening composition having its rheological properties of flow elasticity and viscosity capable of being readily modified as needed independently of each other to satisfy a consumer preference, said composition comprising:

a) from about 0.01% to about 25%, by weight, of a cationic fabric softener;

b) an effective amount of a mixture of cationic polymers capable of modifying the aforesaid rheological properties, said mixture comprising:

(i) from about 0.01% to about 90%, by weight, of a cationic linear homopolymer that is derivable from the polymerization of quaternary ammonium acrylate or methacrylate, a linear copolymer that is derivable from the polymerization of quaternary ammonium acrylate and/or methacrylate and acrylamide or methacrylamide, said homopolymer or copolymer having a molecular weight of from about 10,000 to about 30 million; and (ii) from about 10% to about 99.99%, by weight, of a cationic cross-linked polymer that is derivable from the polymerization of, from 5 to 100 mole percent of cationic vinyl addition monomer, from 0 to 95 mole percent of acrylamide, and from 70 ppm to 300 ppm of a difunctional vinyl addition monomer cross linking agent, the respective amounts of (i) and (ii) in said mixture being selected to provide the desired rheological properties of viscosity and flow elasticity in said softening composition;

c) from 0% to about 10% by weight of a sequestering compound selected from the group consisting of amino-carboxylic acid compounds, organo aminophosphonic acid compounds and mixtures thereof;

d) from 0% to about 5% by weight of a perfume;

e) from 0% to about 10% by weight of an emulsifier;

f) from 0 to about 10% by weight of one or more adjuvants selected from the group consisting of dyes, opacifying agent, bluing agents and preservatives; and g) balance water.

2. A fabric softening composition in accordance with claim 1, which further contains (a) from 0% to about 1% by weight of an electrolyte; and (b) from 0% to about 10% by weight of a co-softener selected from the group consisting of fatty alcohol, glycerol monostearate and glycerol monooleate.

3. A fabric softener composition in accordance with claim 1 wherein said emulsifier is a fatty alcohol ethoxylate nonionic surfactant.

4. A fabric softening composition of claim 1 where said cationic linear polymer comprises a quaternary salt of acrylate or methacrylate.

5. A fabric softening composition of claim 1 where said cationic cross-linked polymer is a cross-linked vinyl polymer.

6. A fabric softening composition of claim 1 where said cationic cross-linked polymer comprises a quaternary salt of acrylare or methacrylate.

7. A fabric composition of claim 1 wherein said cationic softener is selected from the group consisting of quaternary ammonium compounds, esterquats, imidazolinium quats and difatty diamide ammonium methyl sulfate.

8. A fabric softening composition of claim 7 wherein said cationic softener comprises ditallow diester ammonium methosulfate.

9. A method for softening fabrics comprising forming an aqueous solution containing an effective amount of the fabric softening composition of claim 1 and then contacting the fabrics to be softened with said aqueous solution.

* * * * *